United States Patent [19]

Emery, II et al.

[11] Patent Number: 4,948,128

[45] Date of Patent: Aug. 14, 1990

[54] POKER POOL TABLE

[76] Inventors: George B. Emery, II, 4435 Osprey St., San Diego, Calif. 92107; George B. Emery, III, 31561 Tablerock Dr., South Laguna; Charles Conner, 23732 Hillcrest Dr., Laguna Niguel, both of Calif. 92677

[21] Appl. No.: 296,625

[22] Filed: Jan. 13, 1989

[51] Int. Cl.[5] ..... A63B 71/00

[52] U.S. Cl. ..... 273/11 R; 273/14

[58] Field of Search ..... 273/11 R, 11 C, 11 A, 273/49, 14

[56] References Cited

U.S. PATENT DOCUMENTS

| | | | |
|---|---|---|---|
| 803,520 | 10/1905 | Arney | 273/3 A |
| 835,177 | 11/1906 | Callahan | 273/3 A |
| 3,424,456 | 1/1969 | Daddis | 273/11 C |
| 3,447,804 | 1/1969 | Cornell | 273/49 |
| 4,331,186 | 2/1984 | Gold | 273/3 A |
| 4,516,770 | 5/1985 | Brookes et al. | 273/11 R |

*Primary Examiner*—Theatrice Brown
*Attorney, Agent, or Firm*—Charles C. Logan, II

[57] ABSTRACT

A pool table designed to allow various poker games to be played using card values visibly marked on the balls and/or using plain unmarked balls. The plain unmarked balls have a unique electric name tag encoded therein which is read by an electronic reader system mounted beneath the table top. A ball mixing assembly is also mounted below the table top and there is structure for delivering specific or random pool balls upwardly through any of the various pockets of the table where they are then ejected onto the top of the table itself. An electronic circuit is connected to a computer which controls the instructions that are delivered to the various mechanical assemblies so that a variety of poker games may be played. A visual or private display is also connected to the computer to record the poker hands that are being obtained by each player.

7 Claims, 5 Drawing Sheets

POKER POOL TABLE

BACKGROUND OF THE INVENTION

The invention relates to a pool table and more specifically to a uniquely designed pool table that allows games of poker to be played with pool balls.

Pool tables and billard tables have existed for numerous years and have clearly defined rules for playing different games on them. The basic design of the pool table has changed little if at all over the last fifty years. Improvements have been made in the ball return structure, designs have been made so that the pool tables can be operated as coin operated amusement games, but very few other changes have been made. The basic pool table is rectangularly shaped and has six pockets along the perimeter of its playing surface. The balls are generally manually racked and the scores of the games are usually manually tallied.

One of the few new developments in the past fifty years of an amusement table using pool-type balls and cue sticks, is the design of bumper pool tables. The rules of play for this type of pool table were distinctly new.

It is an object of the invention to provide a novel pool table assembly that allows a game of poker to be played using pool balls.

It is also an object of the invention to provide a novel system that allows plain unmarked pool balls to be utilized in a game simulating the play of poker wherein each individual player is the only one who knows what card value balls he has sunk to form his poker hand.

It is another object of the invention to provide a unique pool table unlike any that has ever been built before.

SUMMARY OF THE INVENTION

Applicants' novel Poker Pool table has ten pockets spaced at predetermined locations around its perimeter. The outer contour configuration of its playing surface has been designed to enhance the playing of a game utilizing as many as 108 pool balls.

Poker Pool, as the name implies, is a game which involves playing poker on a pool table. Fifty four balls are used and have the numbers, and suits of cards pictured on the outside surface of the balls. In addition to the fifty four marked balls, the games can be played with fifty four unmarked balls or with a combination of marked and unmarked balls. Games such as draw poker, stud poker, Texan hold-em and at least a dozen other games can be played.

The balls are either racked and broken or dealt from beneath the table and ejected from anyone of the ten pockets at slow, medium or fast speed depending on the strategy required.

The unmarked balls have an electronic name tag so that each ball represents a different card in the different suits, including two jokers, totaling fifty four balls. The eletronic name tag for each pool ball is a different specific weight of an iron oxide mixture that has been placed in the interior of the ball. In other words, each plain unmarked ball actually represents a card which is invisible to the player until it registers on a display. As the ball passes an electronic reader system beneath the table top, the identification registers on a display embedded in the rail around the perimeter of the table. The electronic reader system has means for measuring the permeability of the pool ball as it pass through an oscillator in the electronic reader system. The oscillator has an indicator coil wound around a tubular form whose inside diameter is greater the greater diameter of pool balls so that the balls may travel through the tubular from which allows the oscilator to measure the permeability of the ball and thus identify it. There are six of these displays (one for each player). When a player makes an unmarked ball, such as the king of hearts, it appears on his display and is credited to his hand. A cover conceals each display so the other players can not see his hand. As an example, if you are playing seven-card stud, each player has three hidden or unmarked balls and four exposed or marked balls.

The balls are shuffled or mixed below the table, prior to ejection on to the table. A voice synthesizer, in conjunction with the ejection machinery, instructs the players as to each ones turn, sequence, etc. The voice synthesizer is also programed to emit humorous anticdotes. The specific pocket will be illuminated when a ball is dealt or ejected therefrom. Hanging above the table is a central or public display used for tournament play. A hot box is fastened to the side of the table for betting purposes.

The players, which may be from two to six, initially select the game they wish to play. On selection, a switch triggers the computer. The balls will be either marked or unmarked. Two sections beneath the table hold the balls. With marked balls, a player can visually see which balls are exposed on the table. To use them in his hand he must visually select the ball and depending on his own expertice, shoot the ball into the pocket where it goes down. In this manner he has selected the card or ball that fits his hand. When that particular player is finished playing, the next player engages the player button before his play starts in the rotation. The computer keeps a separate memory for each hand, and every ball that represents a card goes into a pocket gets counted on the computer scoreboard.

If the game is played so the players do not know what one another have, they use unmarked or plain balls and have a covered display on the table. Each player gets to see his hidden hand. No one knows what is in the other person's hand. When publicly display on the hanging display above the table, the player's hands will show on a score board and a voice synthesis system will announce the game through loud speakers. If they wish to push the private button the voice synthesis in the score board is disconnected. The private hands are shown on display having a lip cover. These are located on the four ends of the table so that one player can not view another's hand.

The unmarked balls are coded with an "electronic name tag" and when the ball goes into the pocket, it is read as it passes through the reader system installed in the table. The information is then communicated to the computer. A signal is then processed to activate the voice synthesis (in the event it is turned on) and the scoreboard. Sequential card values such as a royal flush, four of a kind, pairs, etc. are the same as in poker. Basic card rules are used and displayed on a video, billiard-computer and arcade game combined into one. If uses audio and video combined with the aspects of human nature.

In all games the shuffle is similar to shuffling a deck of cards. The balls occur in the same order they went down the pockets on the table in the same manner cards are placed at the bottom of the deck after a hand of play. The balls are shuffled by random mechanical means under computer control. They can be interlaced or placed in numerical sequence or at random in a computer program so the same sequence will not emerge more than once in thousands of shuffles.

The selection of pockets around the table, either clockwise or counter clockwise is done by the players. If a player wants a ball ejected from a pocket he presses the button for ejection from the pocket. Each pocket the ball will come from (when the player takes his finger off the button) is indicated by a flashing light over the pocket. When he keeps the button depressed, the light rotates around the table to where the wishes it to stop. When the player removes his finger from the button, the light stays on at the pocket. When he presses the center button, the ball is ejected from that pocket and as to his previous decision the speed of the ball may be slow, medium or fast. He can use this proceedure to break up a log jamb of balls or use it on the break or for other strategic purposes.

DESCRIPTION OF THE PREFERRED EMBODIMENT

Figure 1:
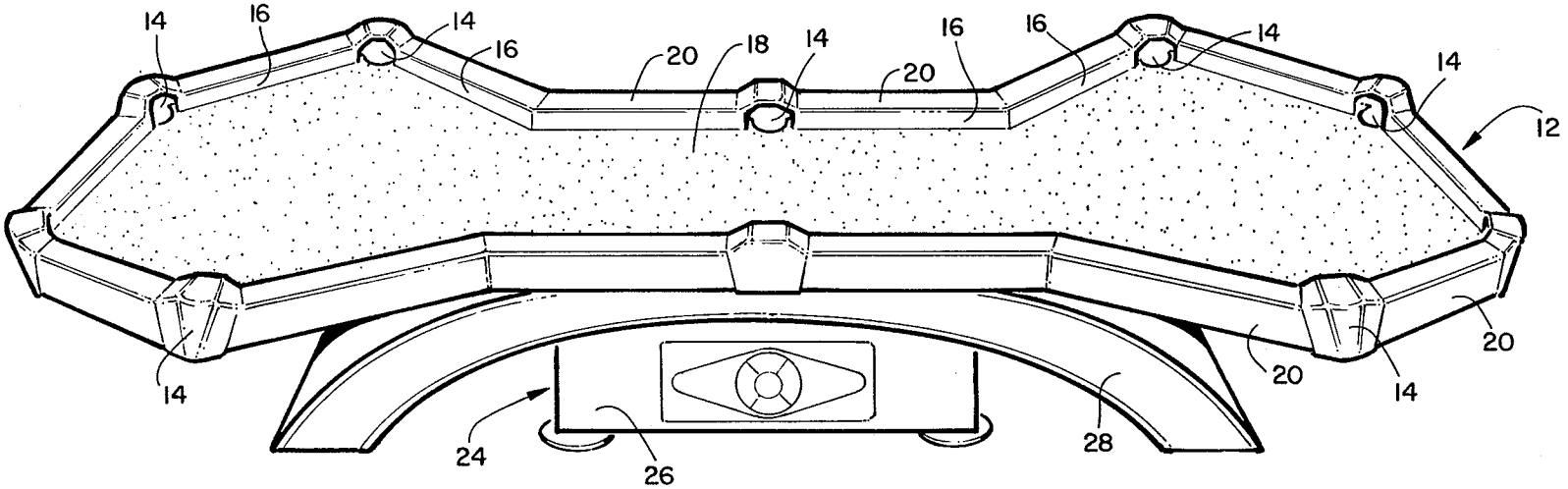
FIG. 1 is a perspective view of applicant's novel Poker Pool table.

The structure of applicant's novel Poker Pool table will now be described by referring to FIGS. 1–10 of the drawings. The Poker Pool table is generally designated numeral 12.

Poker Pool table 12 has ten pockets 14 spaced around its perimeter. Bumper sections 16 extend between the respective pockets. Table top 18 has a conventional structure. Modular panel sections 20 are individually removeable between each of the respective pockets 14 to make it easy for access to be gained to electrical and mechanical components positioned under the table top 18. Likewise the pockets 14 are also modules that can be removed as a singularly assembled structure. The upper portion of the pool table 12 is supported by the base assembly 24.

Base assembly 24 has a steel framework consisting of horizontal and vertical steel members that have been welded together. Decorative panels such as that identified by the numeral 26 cover this framework. Welded to the top of base assembly 24 is horizontal framework of steel members which provide a support for table top 18. Curved legs 28 are purely decorative and do not provide a support function.

Figure 2:
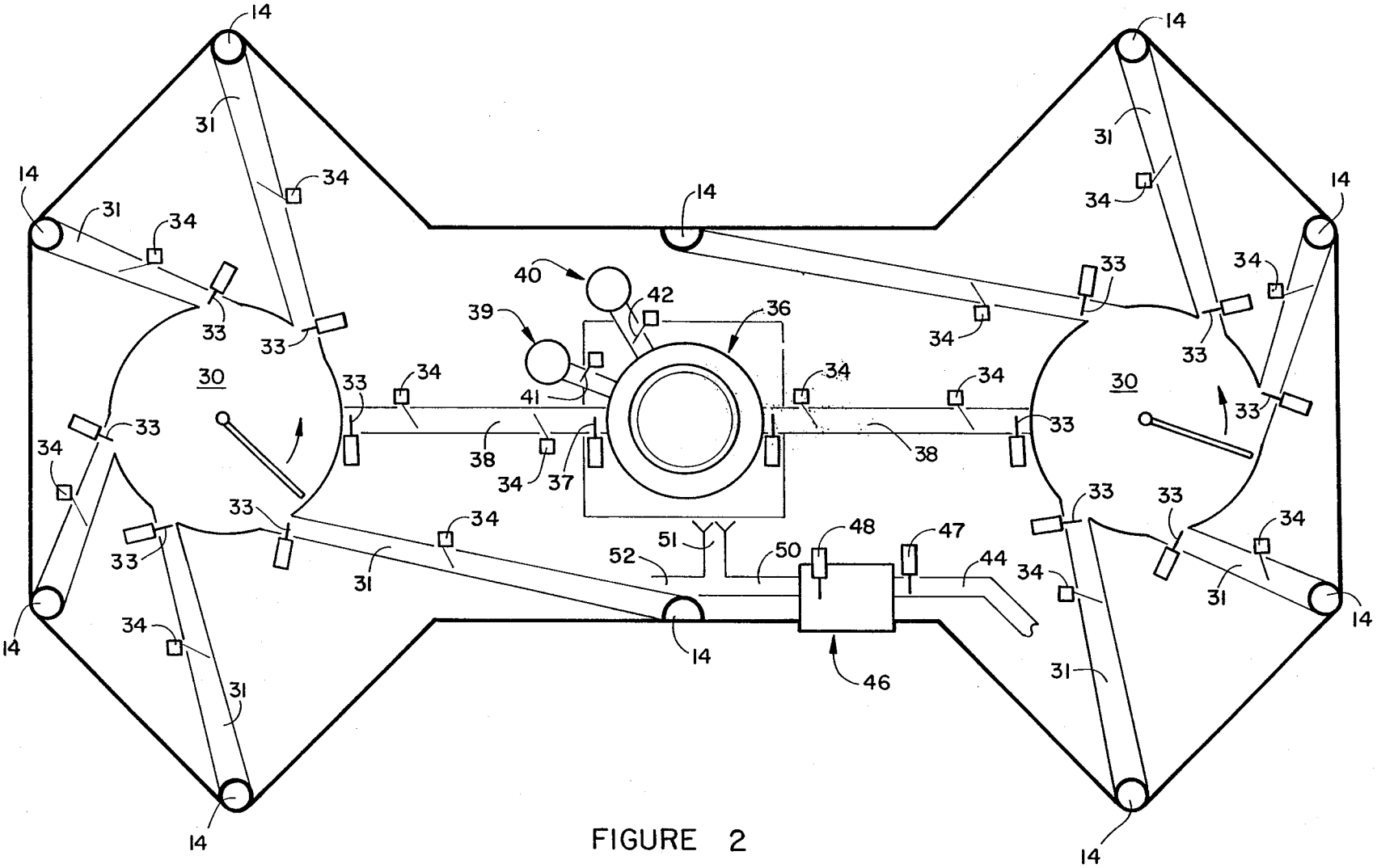
FIG. 2 is a schematic illustration that gives an overall general view of most of the structure and equipment located beneath the table top of the Poker Pool table.

The schematic illustration seen in FIG. 2 gives an overall view of the interrelationship of the different electrical and mechanical components positioned beneath the table top of the pool table. A pair of velocity machines 30 are centered in each of the longitudinal ends of the pool table. A trough 31 extends downwardly from each of the pockets 14 to provide a gravity chute for each ball that is shot into the pockets 14. In the respective troughs at a position adjacent the velocity machines, a solenoid operated gate is positioned to close or open a path for the pool balls. A ball sensor 34 is also positioned along each trough 31 to keep track of the presence of any ball that passes thereby.

A carousel assembly 36 is positioned centrally beneath the table top 18. It has troughs 38 which slope slightly downwardly therefrom toward the respective velocity machines at the outer ends of the table. Solenoid operated gates 37 must be actuated to allow the balls to travel from carousel 36 into either of the respective troughs 38.

Elevator assemblies 39 and 40 function to lift the balls from the ball return troughs upwardly to the carousel assembly 36. The respective solenoid operated gates 41 and 42 must be actuated before a ball from either of the elevator assemblies will be allowed to drop into the carousel assemly.

A ball return trough 44 has a gentle inclination to it that allows a which has been made at one of respective pockets 14 to ultimately proceed to the ball ID electronic reader assembly 46. An entrance solenoid actuated gate 47 bars the path of the ball until it is allowed to enter. A solenoid actuated gate 48 prevents the ball from exiting until it receives a signal to open. As the ball leaves the ball ID electronic reader assembly 46 it travels through trough 50 and it is then directed into either trough 51 or trough 52 depending upon which ball return storage trough it is suppose to enter. One of the storage troughs would be for visually marked balls and the other storage trough would be for the unmarked balls.

Figure 3:
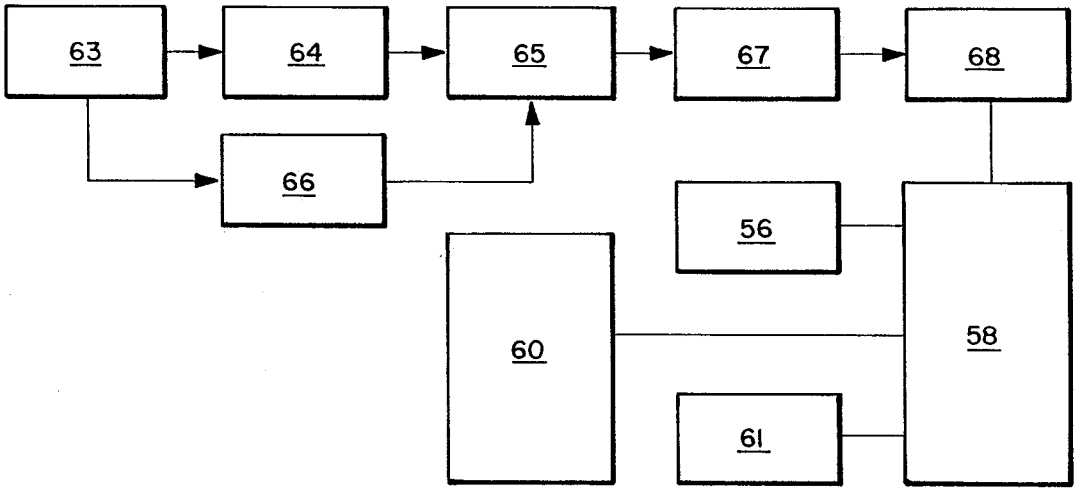
FIG. 3 is a block diagram depicting the manner in which the various components of the poker pool table interrelate with each other.

The block diagram illustrated in FIG. 3 depicts the manner in which the various components of the Poker Pool table interrelate with each other. Game select unit 56 is connected to computer 58 and it sends its programed signals to the various mechanical assemblies and electrical components such as the two elevator assemblies, the carousel, the two velocity machines, the solenoid actuated gates, and the sensors that identify the balls. These components and assemblies are all lumped in the block identified by the numeral 60. Computer 58 also sends signals to the visual display unit 61. The process of identifying an unmarked or marked ball starts with it passing through the frequency oscillator 63. This sends a signal to the radio frequency amplifier 64 and then on to the error correction unit 65 which is also receiving concurrently information from the frequency standard reference 66. The corrected frequency then passes on to the frequency counter 67 and then on to digital display unit 68 that displays the identified balls number after which this information is directed on to the computer 58.

Figure 4:
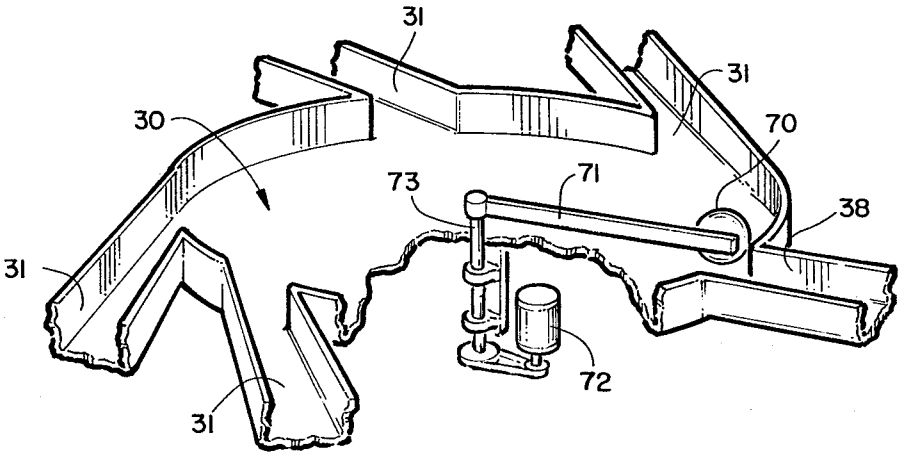
FIG. 4 is a front perspective view of one of the velocity machines with portions broken away.

A better understanding of the velocity machine 30 will be understood by referring to FIG. 4. After a ball 70 has been properly directed to velocity machine 30, it will travel there from carousel assembly 36 along trough 38. At this time the player whose turn it is, will choose a pocket through which ball 70 is to be ejected onto table 18. At this time he will also decide whether he wants it to be fed on at a slow, medium or fast speed. Accordingly a signal is sent to motor 72 which is connected by conventional pulleys and a belt to a vertically oriented drive shaft 73 that has an arm 71 mounted on its top end. The ball 70 will be caused to accelerate with the velocity machine 30 and the proper solenoid actuated gate 33 will be actuated to allow the ball to pass into its predetermined trough 31.

Figure 5:
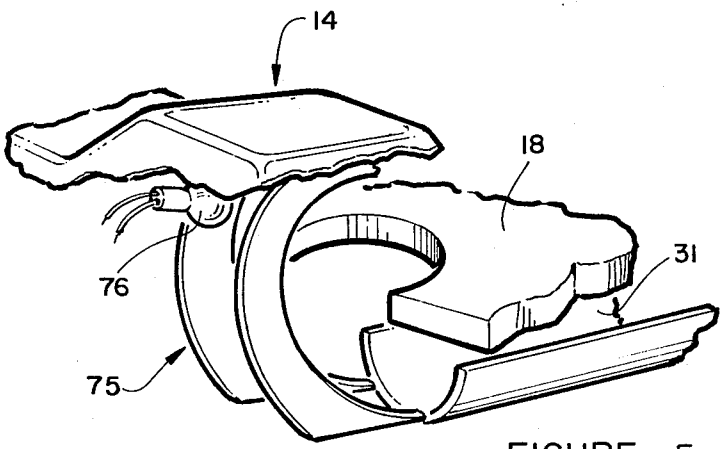
FIG. 5 is a perspective view of one of the corner pockets with portions broken away.

One of the pocket assemblies 14 is illustrated in FIG. 5 with portions broken away for clarity. It can be seen that a trough 31 will allow a previously directed pool ball 70 to travel from the velocity machine 30 to curved ejector tracks 75. The speed at which the ball approached ejector tracks 75 causes it to travel upwardly and outwardly onto table 18. Some form of electrical light unit 76 would be contained in the top portion of pocket assembly 14 and it would be lit when that is the pocket to which the player wishes it to be ejected from.

Figure 6:
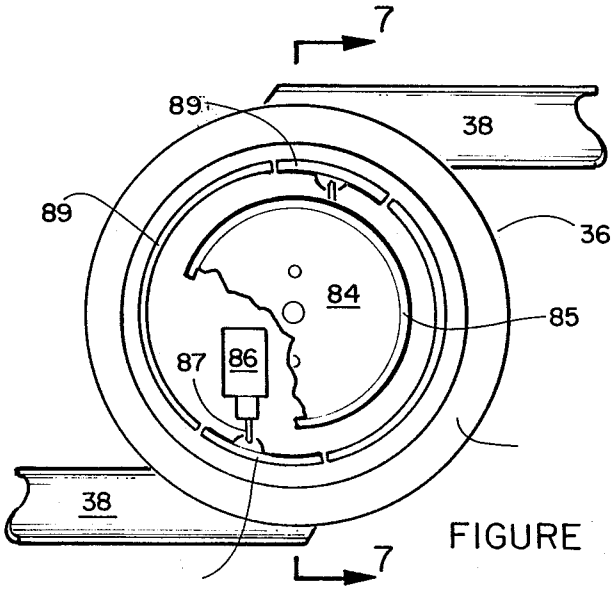
FIG. 6 is a top plan view of the carousel assembly with portions broken away.
Figure 7:
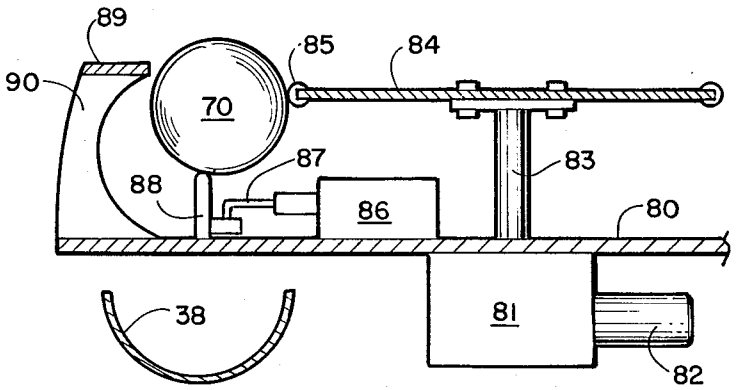
FIG. 7 is a cross sectional view taken along lines 7—7 of FIG. 6.

The operation of carousel assembly 36 will now be described by referring to FIGS. 6 and 7. It has a platform base 80 having a gear box 81 and an electric motor 82 mounted therebelow. Extending upwardly from gear box 81 is a drive shaft 83 whose top end is secured to a disc 84 having a high friction ring 85 attached on its perimeter. A solenoid 86 has a rod arm 87 secured to an arcuate rail 88. When a ball has been deposited on carousel 36 from one of the two elevators, it will come to rest on the top edge of acruate rail 88 between friction ring 85 and the inner edge of annular ring 89. Since the player whose turn it is, has already previously actuated the control for sending ball 70 to a predetermined velocity machine, motor 82 will be actuated which will cause disc to rotate and the friction contact between it and ball 70 will cause the ball roll around the arcuate track to a predetermined spot adjacent one of the exit ports 90 of one of the troughs 38 that travels to one of the velocity machines 30. Pool ball 70 tends to rest against friction ring 85 due to the fact that arcuate rail 88 is at a point outwardly from the center of the ball itself. When the ball 70 has reached its predetermined exit port 90, solenoid 86 is actuated which results in rod arm 87 pulling arcuate rail radially inwardly a sufficient distance to thereby allow ball 70 to drop downwardly through exit port 90.

Figure 8:
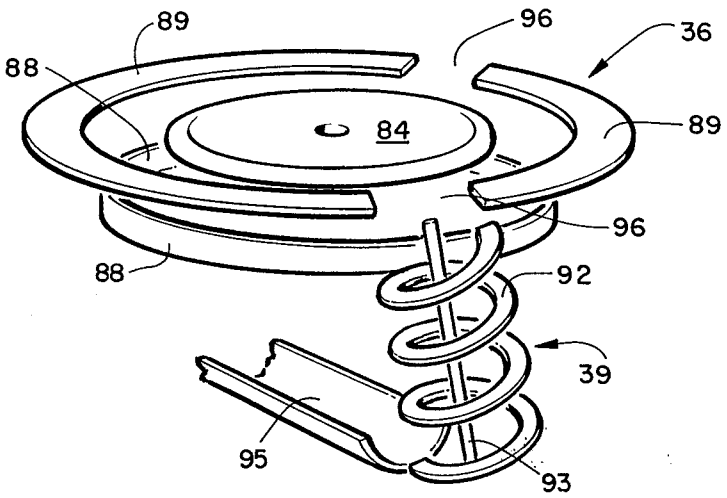
FIG. 8 is a perspective view of one of the elevators showing its interrelationship with the carousel.

One of the elevator assemblies 39 is illustrated in FIG. 8 along with its interrelationship with carousel 36. Elevator assembly 39 has a helical screw 92 having a rod 93 passing upwardly through its interior and they are both inclined at an angle between 5–10 degrees offset from vertical. One of the ball return storage troughs 95 receives the return balls as they return downwardly due to gravity and onto the bottom end of helical screw 92. Helical screw 92 and shaft 93 are turned in unison at periods of time when a ball is not being directed from the carousel 36 to one of the velocity machines and then onwardly to one of the ejection rails. As one of the pool balls is directed upwardly along helical screw 92 it reaches an upper position adjacent an inlet port 96. When a proper signal is received, an arm (not shown) will direct the ball into the interior of the carousel 36 where it will rest upon arcuate rail 88. Elevator 39 may also be used in coordination with a device for pushing one of the balls passing upwardly along the elevator off onto a trough that will direct it down into the ball return storage trough allowing it to drop into a random position in the line of balls that are being stored therein. This functions as a shuffling mechanism.

Figure 9:
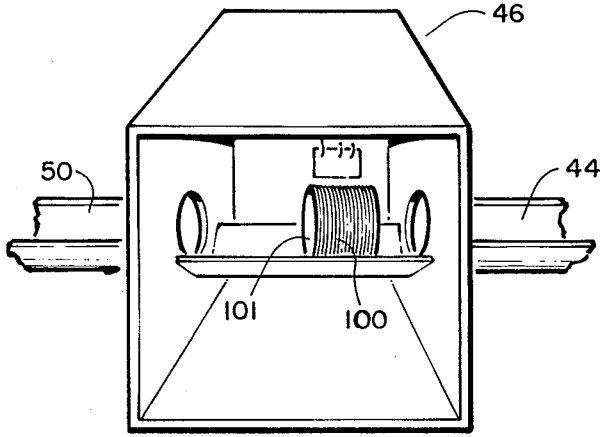
FIG. 9 is a front perspective view illustrating the electronic reader system and its housing.

The housing for ball ID electronic reader 46 is illustrated in FIG. 9. It houses an induction coil 100 that is wrapped around a polythylene tube 101. The diameter of tube 101 is slightly greater than the diameter of the pool balls 70. Each pool ball has its own unique electronic name tag that is produced by a specific weight of iron oxide mixture placed in the interior of the ball. The electronic reader system has an oscillator for measuring the permeability of a pool ball as it passes through the system. As the pool ball passes through the inductor coil 100 of an identification oscillator 63, it will be identified by the change in frequency that is noted in the manner that has been previously discussed.

Figure 10:
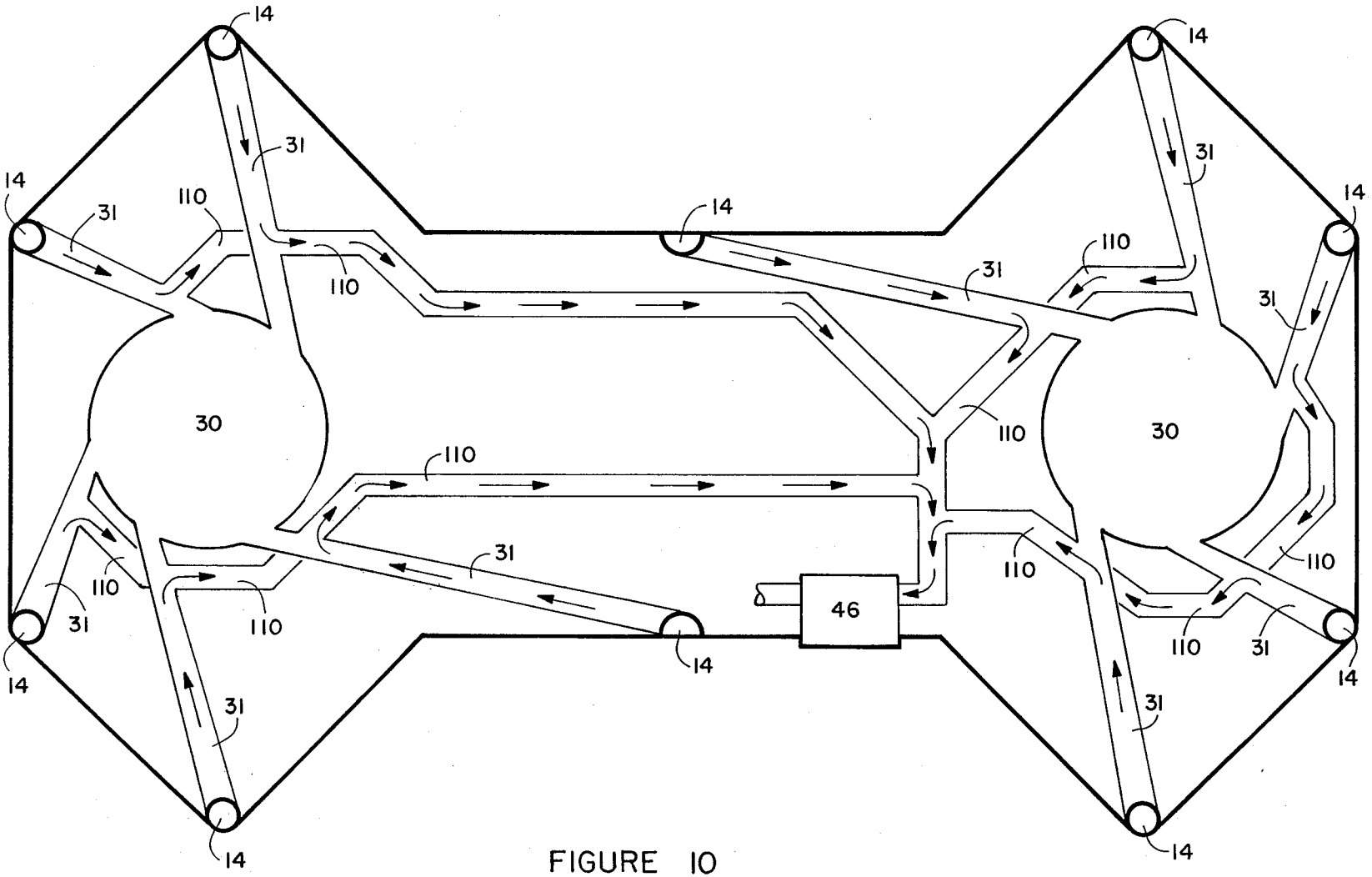
FIG. 10 is a schematic illustration of the ball return system.

The ball return system and its intertwined network of return troughs is schematically illustrated in FIG. 10. Detailed is the path of travel that ball will take after it has been shot into any of the pockets around the pool table. The reason for the balls not traveling into the interior of the respective velocity machines 30 is due to the fact that the gates 33 would be closed at that time and cause the balls to be redirected to a lower tier of return troughs.

We claim:

1. A pool table comprising:

a horizontally oriented table top having a predetermined perimeter configuration;

a plurality of pool ball pockets positioned around the perimeter of said table top;

bumper rails positioned around the perimeter of said table top, said bumper rails extending between each successive pair of pool ball pockets;

a ball return storage unit;

ball return means connecting said pool ball pockets in said ball return units;

a first set of pool balls each having its own electronic name tag, each said electronic name tag being an iron oxide mixture having specific weight different from the other and being placed in each said interior of the pool ball; and said ball return means comprising an electronic reader system for identifying each pool ball passing through said system.

2. A pool table as recited in claim 1 wherein the predetermined perimeter configuration of said table top has twelve sides.

3. A pool table as recited in claim 1 wherein there are ten pool ball pockets positioned around the perimeter of said table top.

4. A pool table as recited in claim 1 wherein said set of pool balls has one marked to represent each of the cards of a conventional deck of cards.

5. A pool table comprising:

a horizontally oriented table top having a predetermined perimeter configuration;

a plurality of pool ball pockets positioned around the perimeter of said table top;

bumper rails positioned around the perimeter of said table top, said bumper rails extending between each successive pair of pool ball pockets;

a ball return storage unit;

ball return means connecting said pool ball pockets and said ball return unit;

a first set of pool balls each having its own electronic name tag; and said ball return means comprising an electronic reader system for identifying each pool ball passing through said system, said electronic reader system having means for measuring the permeability of the pool ball as it passes through the system.

6. A pool table as recited in claim 5 wherein said means for measuring the permeabilityof the pool ball comprises an oscillator.

7. A pool table as recited in claim 6 wherein said oscillator has an induction coil wound around a tubular form whose inside diameter is greater than the outside diameter of said pool balls so that they may travel through said tubular form which allows the oscillator to measure the permeability of the ball and thus identify it.

* * * * *